US009453649B2

(12) United States Patent
Kubono

(10) Patent No.: US 9,453,649 B2
(45) Date of Patent: Sep. 27, 2016

(54) OUTDOOR UNIT AND AIR-CONDITIONING APPARATUS

(71) Applicant: Mitsubishi Electric Corporation, Tokyo (JP)

(72) Inventor: Toshiyuki Kubono, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/446,553

(22) Filed: Jul. 30, 2014

(65) Prior Publication Data

US 2015/0042216 A1 Feb. 12, 2015

(30) Foreign Application Priority Data

Aug. 6, 2013 (JP) ..... 2013-163481

(51) Int. Cl.
*F24F 13/00* (2006.01)
*F24F 1/56* (2011.01)
*F24F 1/46* (2011.01)

(52) U.S. Cl.
CPC .. *F24F 1/56* (2013.01); *F24F 1/46* (2013.01)

(58) Field of Classification Search
CPC ..... F24F 1/06; F24F 1/56; F24F 1/58
USPC ..... 312/100
See application file for complete search history.

(56) References Cited

U.S. PATENT DOCUMENTS

| | | | | |
|---|---|---|---|---|
| 5,775,119 | A * | 7/1998 | Yamada et al. | 62/259.1 |
| 8,763,416 | B2 * | 7/2014 | Hika et al. | 62/298 |
| 2006/0130516 | A1 * | 6/2006 | Sugiyama et al. | 62/507 |
| 2010/0116461 | A1 * | 5/2010 | Saito et al. | 165/62 |
| 2014/0144167 | A1 * | 5/2014 | Yamauchi et al. | 62/259.1 |
| 2015/0040446 | A1 * | 2/2015 | Nakasu et al. | 40/625 |
| 2015/0043133 | A1 * | 2/2015 | Yanase et al. | 361/627 |

FOREIGN PATENT DOCUMENTS

| | | | |
|---|---|---|---|
| JP | 61-72971 | A | 4/1986 |
| JP | S62-135036 | U | 8/1987 |
| JP | 09-112966 | A | 5/1997 |
| JP | 2007-113861 | A | 5/2007 |
| JP | 2009-174760 | A | 8/2009 |

OTHER PUBLICATIONS

English translation of JP 61-072971. Dec. 2015.*
Extended European Search Report issued Sep. 28, 2015 in the corresponding EP application No. 14179644.1.
Office Action mailed Nov. 17, 2015 issued in corresponding JP patent application No. 2013-163481 (and English translation).
Office Action issued Jun. 14, 2016 in the corresponding JP application No. 2013-163481 (with English translation).
Office Action mailed Jul. 22, 2016 issued in corresponding Chinese patent application No. 201410370706.7 (and English translation).

* cited by examiner

*Primary Examiner* — Daniel Rohrhoff
(74) *Attorney, Agent, or Firm* — Posz Law Group, PLC

(57) ABSTRACT

In an outdoor unit, an upper corner bend portion is connected to a linear portion of a flange via an inclined portion that is located inside an ideal bending line of the upper corner bend portion.

7 Claims, 4 Drawing Sheets

OUTDOOR UNIT AND AIR-CONDITIONING APPARATUS

CROSS REFERENCE TO RELATED APPLICATION

This application is based on and incorporates herein by reference Japanese Patent Application No. 2013-163481 filed on Aug. 6, 2013.

TECHNICAL FIELD

The present invention relates to an outdoor unit for an air-conditioning apparatus, and an air-conditioning apparatus including the outdoor unit. More specifically, the present invention relates to the outer shell structure of an outdoor unit.

BACKGROUND ART

In general, an outdoor unit of an air-conditioning apparatus has a casing that is formed by an outer shell panel constituting the front surface and a part of the side surface, a top panel constituting the top surface, and a side panel constituting a part of the side surface. As for the outer shell panel, a sheet metal component constituting a single panel is bent in a curved shape at right angles to form the front surface of the outdoor unit and the side surface of the outdoor unit. This outer shell panel is combined with the side panel, and the top panel is mounted to the upper side of these panels to thereby complete the casing.

The top panel is placed over the outside of the upper side of the bent portion of the outer shell panel (hereinafter, the bent portion is referred to as upper corner bend portion). Because the outer shell panel is formed by bending a sheet metal component in a curved shape at right angles, as this curved portion contracts, wrinkles form in the upper corner bend portion. Accordingly, there has been proposed an outdoor unit in which a cut is made in the upper corner bend portion to reduce its height, thereby minimizing formation of wrinkles (see, for example, Patent Literature 1).

CITATION LIST

Patent Literature

[Patent Literature 1] Japanese Unexamined Patent Application Publication No. 2007-113861 (paragraph [0049], FIG. 3 and the like)

SUMMARY OF INVENTION

Technical Problem

However, if there are wrinkles in the upper corner bend portion, the wrinkled portion lies outside what would be as an ideal bending line. Consequently, when mounting the top panel to the upper side of the outer shell panel, the top panel does not fit the upper side of the outer shell panel with accuracy, resulting in deterioration of workability. Further, forcefully pushing the top panel to the upper side of the outer shell panel for fitting causes rubbing between the top panel, and the portion of the wrinkles in the outer shell panel, the portion lying outside what would be as the ideal bending line. Therefore, there is a possibility that the coating in the contact portion comes off, causing rust to form in that portion.

With techniques that involve bending a sheet metal component in a curved shape at right angles, including the technique described in Patent Literature 1, formation of wrinkles cannot be made zero owing to the characteristics of sheet metal component forming. That is, although the technique described in Patent Literature 1 has the possibility of reducing formation of wrinkles, formation of wrinkles cannot be made zero as long as the technique involves bending a sheet metal component. Therefore, it cannot be said that the above-mentioned problems can be solved.

The present invention has been made to solve the above-mentioned problems. Accordingly, it is an object of the present invention to provide an outdoor unit and an air-conditioning apparatus which have a structure that prevents formation of rust, without deterioration of workability even with the formation of wrinkles in an upper corner bend portion.

Solution to Problem

An outdoor unit according to the present invention includes a first panel that has a corner bend portion, the corner bend portion having been subjected to bending together with a flange formed in an upper portion of the first panel, and a second panel that has a side surface, the second panel being attached to an upper portion of the first panel in such a way that an outer surface of the flange of the first panel comes into contact with an inner surface of the side surface. The corner bend portion of the flange is connected to a linear portion of the flange via an inclined portion, the inclined portion being a portion where a beginning portion of the corner bend portion is inclined at a predetermined angle in a bending direction.

An air-conditioning apparatus according to the present invention includes the outdoor unit mentioned above, and an indoor unit that is connected to the outdoor unit.

Advantageous Effects of Invention

In the outdoor unit according to the present invention, the corner bend portion of the flange is connected to the linear portion of the flange via an inclined portion. As a result, no rubbing or the like occurs between wrinkles that form in the corner bend portion of the flange and the inner surface of the corner portion of the second panel. Therefore, formation of rust can be minimized, without deterioration of workability when fitting the second panel.

Because the air-conditioning apparatus according to the present invention is provided with the outdoor unit mentioned above, degradation of quality can be minimized.

DESCRIPTION OF EMBODIMENTS

Figure 1:
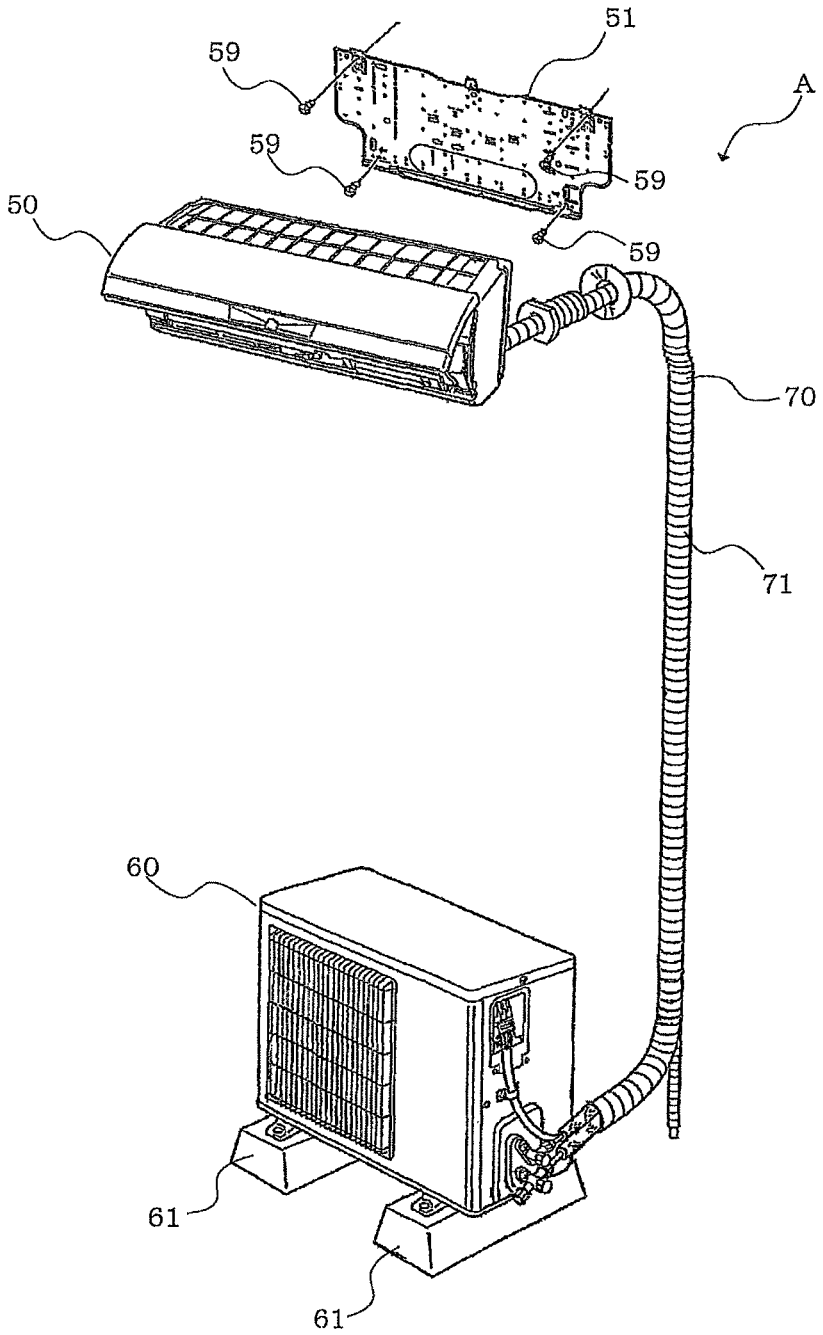
FIG. 1 is a schematic diagram illustrating a general configuration of an air-conditioning apparatus including an outdoor unit according to Embodiment of the present invention.

Hereinafter, Embodiment of the present invention will be described with reference to the drawings. It is to be noted that in the drawings described below including FIG. 1, the relative sizes of individual components may differ from the actual ones in some cases. Further, in the following figures including FIG. 1, identical or equivalent elements will be denoted by the same reference signs, and the same applies throughout this specification. Further, the forms of components described throughout this specification are illustrative only, and not intended to be limitative.

Figure 2:
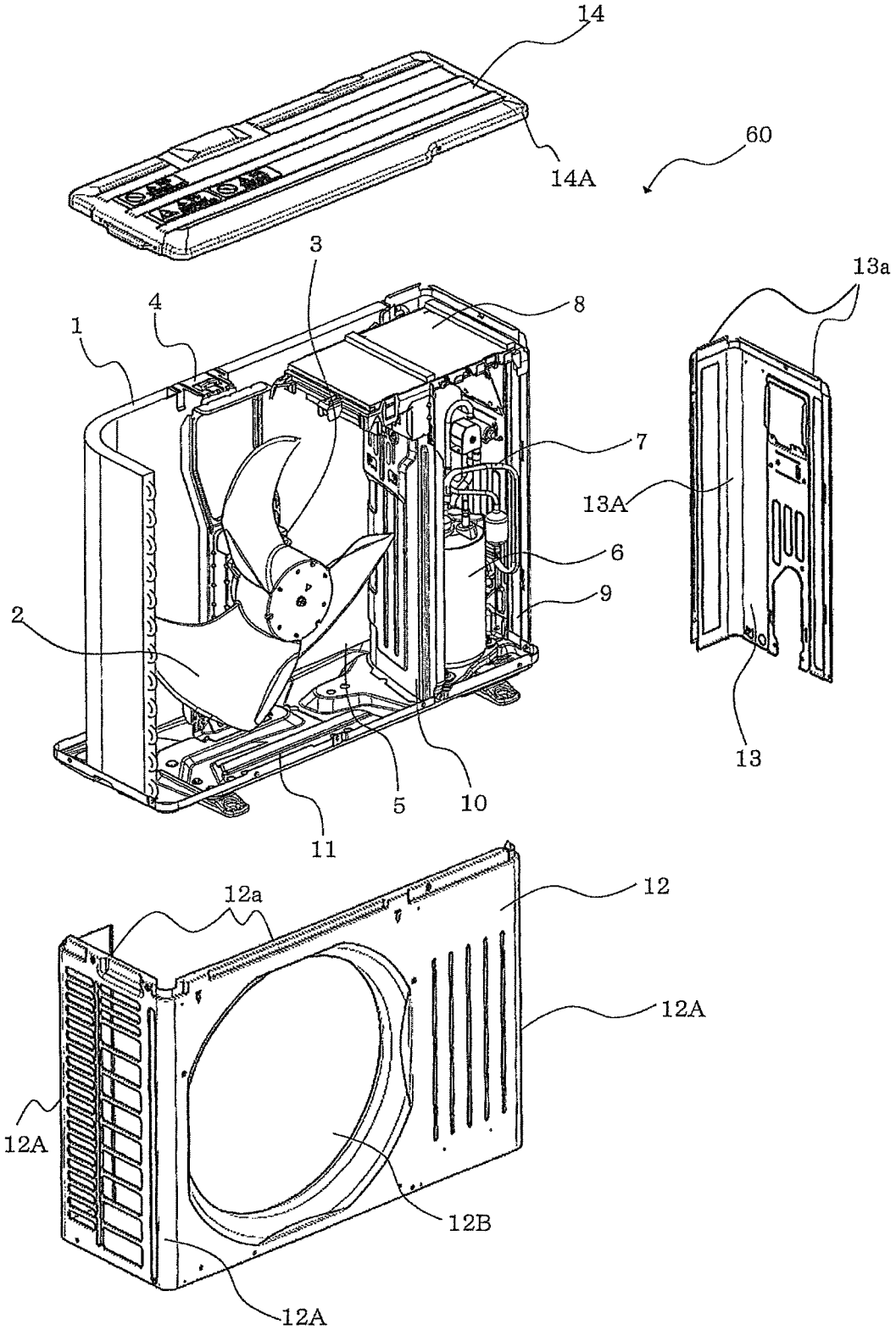
FIG. 2 is an exploded perspective view illustrating a configuration of an outdoor unit according to Embodiment of the present invention.

FIG. 1 is a schematic diagram illustrating a general configuration of an air-conditioning apparatus A including an outdoor unit 60 according to Embodiment of the present invention. FIG. 2 is an exploded perspective view illustrating a configuration of the outdoor unit 60. The configurations of the outdoor unit 60 and air-conditioning apparatus A will be described below with reference to FIGS. 1 and 2. The outdoor unit 60 has a structure that prevents formation of rust, without deterioration of workability, even with the formation of wrinkles in an upper corner bend portion 12*b* of an outer shell panel 12.

The air-conditioning apparatus A is used as, for example, a separate-type household air-conditioning apparatus. The air-conditioning apparatus A has an indoor unit 50 and the outdoor unit 60. The indoor unit 50 is secured in the following manner. That is, an installation plate 51 is secured onto, for example, a wall surface on the indoor side with screws 59 or the like, and the indoor unit 50 is hung on the installation plate 51. The indoor unit 50 supplies conditioned air to an air-conditioning target space. The outdoor unit 60 is secured in the following manner. That is, a support base 61 is installed in a space (for example, outdoors) different from the air-conditioning target space, and the outdoor unit 60 is placed on the support base 61. The outdoor unit 60 supplies cooling energy or heating energy to the indoor unit 50. The outdoor unit 60 may be installed at such a position that can provide a passage for air during operation and is not very far from the indoor unit 50.

The indoor unit 50 and the outdoor unit 60 are coupled together by using an extension pipe (refrigerant pipe) 70 that is flared. As a result, the constituent devices of the indoor unit 50 and the constituent devices of the outdoor unit 60 are connected by the pipe, thereby forming a refrigerant circuit. The indoor unit 50 and the outdoor unit 60 are electrically connected to each other.

(Indoor Unit 50)

The indoor unit 50 has an indoor heat exchanger, an indoor air-sending motor, a blower fan, and the like. The indoor heat exchanger functions as a condenser (radiator) in heating operation, and as an evaporator in cooling operation. The indoor air-sending motor and the blower fan are positioned forward of the indoor heat exchanger, and blow air to the indoor heat exchanger. The indoor unit 50 has on its upper surface an air inlet 57 for sucking air from the air-conditioning target space. The indoor unit 50 also has an air outlet 58 in a lower part of its front surface. The air outlet 58 allows air sucked from the air inlet 57 to pass to the indoor heat exchanger for heat exchange, and blows conditioned air to the air-conditioning target space.

(Outdoor Unit 60)

The outdoor unit 60 accommodates a compressor 6, a refrigerant pipe 7, an electrical parts box 8, an L-bend heat exchanger 1, a propeller fan 2, a motor 3, and a motor support 4. The compressor 6 is of, for example, a variable rotation speed type and compresses refrigerant. The refrigerant pipe 7 is connected to the compressor 6. The electrical parts box 8 accommodates a driving device that drives the compressor 6 and the motor 3. The L-bend heat exchanger 1 functions as an evaporator in heating operation, and as a condenser (radiator) in cooling operation. The propeller fan 2 sends air to the L-bend heat exchanger 1. The motor 3 rotationally drives the propeller fan 2. The motor support 4 holds the motor 3. Further, the outdoor unit 60 also accommodates a flow control device (pressure-reducing unit) that reduces the pressure of refrigerant, a four-way valve that switches the flow of refrigerant, and the like.

The outdoor unit 60 is provided with a separator 10. The separator 10 partitions the internal space of the outdoor unit 60. The L-bend heat exchanger 1, the propeller fan 2, the motor 3, and the motor support 4 are accommodated in an air-sending-device room 5 that is partitioned off by the separator 10. The compressor 6, the refrigerant pipe 7, and the electrical parts box 8 are accommodated in a machine room 9 that is partitioned off by the separator 10. Further, the compressor 6, the L-bend heat exchanger 1, the motor support 4, and the separator 10 are held on top of a base plate 11. An upper portion of the motor support 4 is hung on an upper portion of the L-bend heat exchanger 1.

The entirety of the outdoor unit 60 is covered by a plurality of panels to thereby form a casing constituting the outer shell. The plurality of panels include the outer shell panel 12, a side panel 13, and a top panel 14. The outer shell panel 12 is formed of a front panel and a left side surface part that are integrated together. The side panel 13 is formed of a right side surface part and a right end portion of a back surface part that are integrated together. The top panel 14 is attached to the upper ends of the outer shell panel 12 and the side panel 13, and constitutes an upper surface and covers an upper portion. The outer shell panel 12 and the side panel 13 may be integrated together. The outer shell panel 12 and the side panel 13 each correspond to "first panel" according to the present invention. The top panel 14 corresponds to "second panel" according to the present invention.

A flange 12*a* is formed in an upper end portion of the outer shell panel 12. The flange 12*a* is shaped so that the upper end portion of the outer shell panel 12 is located inside the outer shell panel 12. A flange 13*a* is also formed in an upper end portion of the side panel 13. The flange 13*a* is shaped so that the upper end portion of the side panel 13 is located inside the side panel 13. Accordingly, in a state in which the top panel 14 is attached, the outer surfaces of the flanges 12*a* and 13*a* are in contact with the inner surface of a side surface 14A of the top panel 14. However, it is not requisite that the entirety of the outer surfaces of the flanges 12*a* and 13*a* is in contact with the side surface 14A of the top panel 14.

The outer shell panel 12 is formed by bending a sheet metal component constituting the outer shell panel 12 in a curved shape at around 90 degrees. The outer shell panel 12 has three corner bend portions as illustrated in FIG. 2. Likewise, the side panel 13 is formed by bending a sheet metal component constituting the side panel 13 in a curved shape at around 90 degrees. The side panel 13 has one corner bend portion as illustrated in FIG. 2. The corner bend portions of the outer shell panel 12 are depicted in the figure as corner bend portions 12A, and the corner bend portion of the side panel 13 is depicted as a corner bend portion 13A.

Accordingly, in a state in which the top panel 14 is attached, the outer shell panel 12 and the side panel 13 are in contact with the inner surface of the side surface 14A of the top panel 14 also at the positions of their corner bend portions (four locations at the left, right, front, and back).

Figure 3:
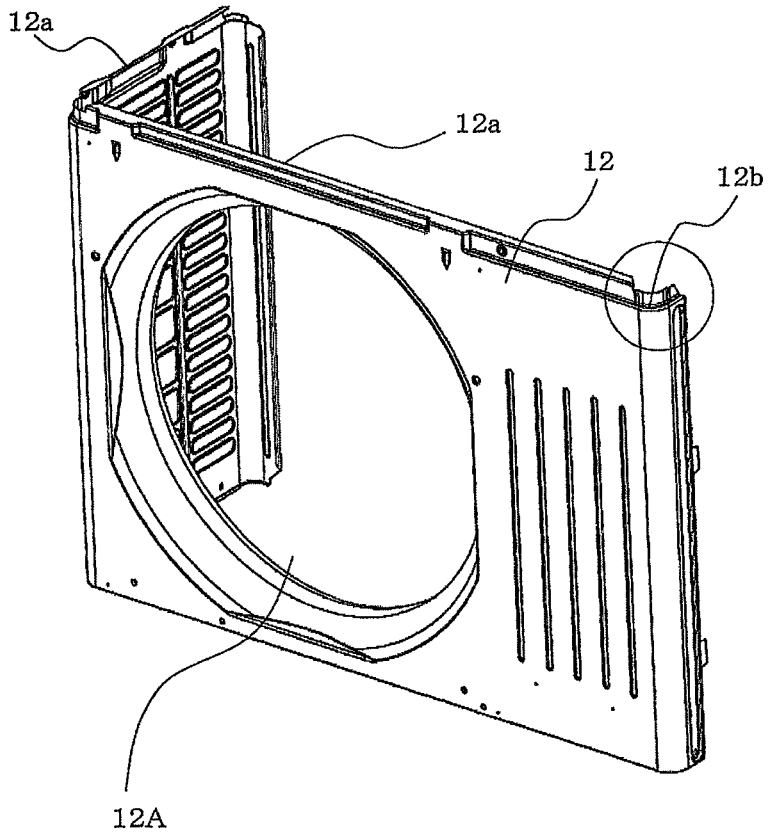
FIG. 3 is an enlarged perspective view illustrating a configuration of an outer shell panel of an outdoor unit according to Embodiment of the present invention.
Figure 4:
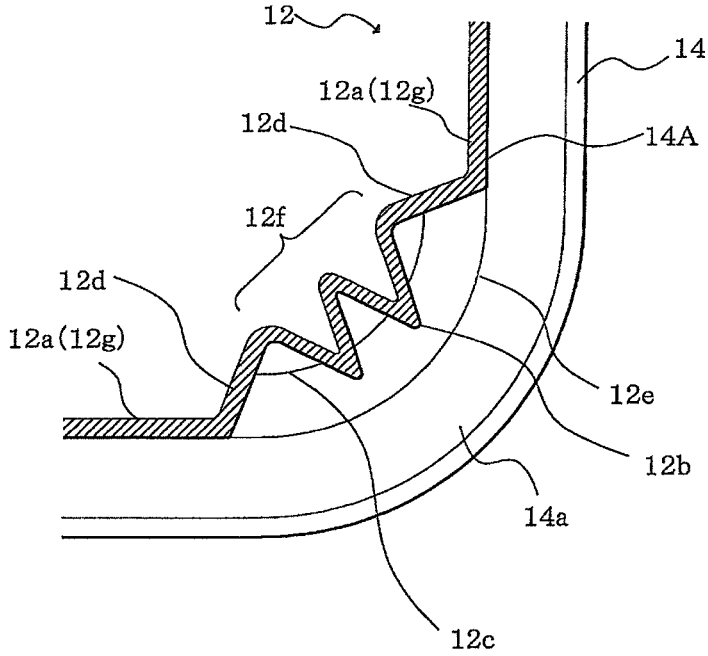
FIG. 4 is a schematic cross-sectional view for explaining an upper corner bend portion of an outer shell panel of an outdoor unit according to Embodiment of the present invention.
Figure 5:
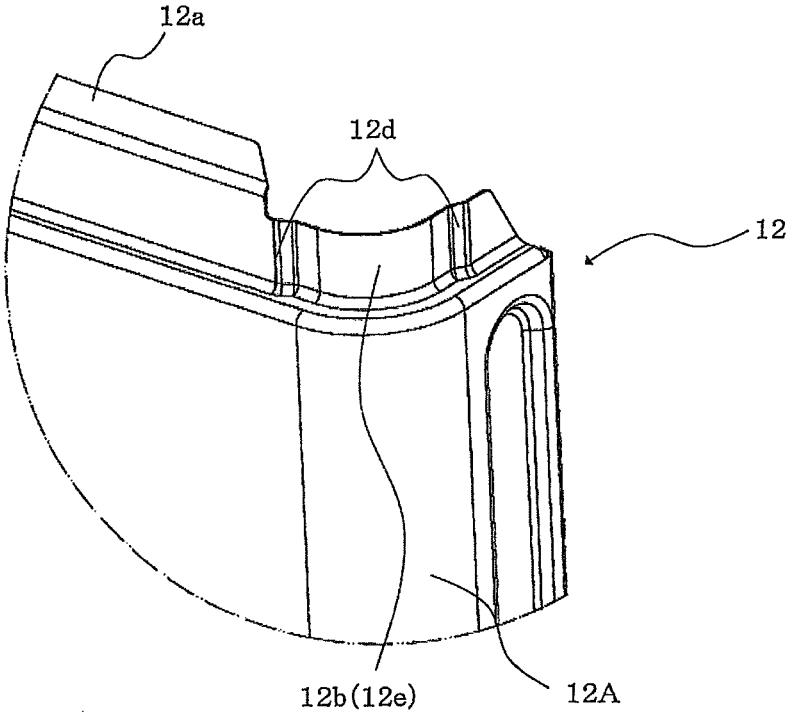
FIG. 5 is an enlarged perspective view for explaining an upper corner bend portion of an outer shell panel of an outdoor unit according to Embodiment of the present invention.
Figure 6:
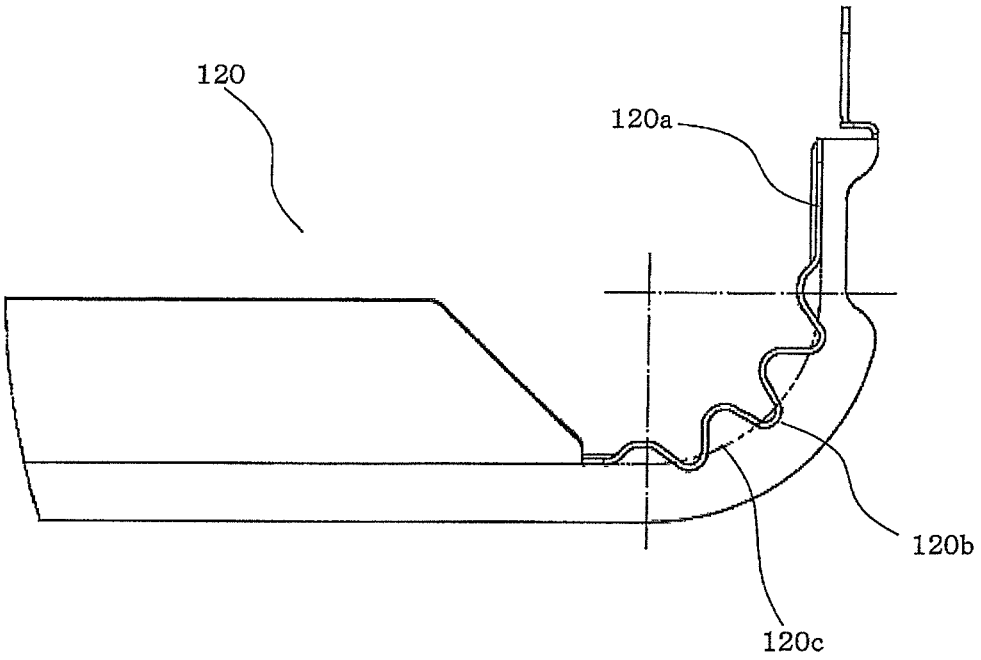
FIG. 6 is a schematic drawing for explaining an upper corner bend portion of an outer shell panel of a conventional outdoor unit.

FIG. 3 is an enlarged perspective view illustrating a configuration of the outer shell panel 12 of the outdoor unit 60. FIG. 4 is a schematic cross-sectional view for explaining the upper corner bend portion 12*b* of the outer shell panel 12 of the outdoor unit 60. FIG. 5 is an enlarged perspective view for explaining the upper corner bend portion 12*b* of the outer shell panel 12 of the outdoor unit 60. FIG. 6 is a schematic drawing for explaining an upper corner bend portion of an outer shell panel of a conventional outdoor unit. The upper corner bend portion 12*b* of the outer shell panel 12 will be described in detail with reference to FIGS. 3 to 5. In this description, reference will be made to a conventional structure illustrated in FIG. 6 as appropriate. The conventional outdoor unit illustrated in FIG. 6 will be differentiated by adding "0" to the end of reference signs.

As described above, the corner bend portions 12A of the outer shell panel 12 are formed by bending a sheet metal component constituting the outer shell panel 12 in a curved shape at around 90 degrees. Further, the flange 12*a* is formed in the upper end portion of the outer shell panel 12. That is, the flange 12*a* is also bent in a curved shape at around 90 degrees. In the following description, among the corner bend portions 12A, the corner bend portion 12A formed in the flange portion will be referred to as upper corner bend portion 12*b*.

FIG. 6 illustrates an ideal bending line 120*c* of an upper corner bend portion 120*b* for the case where a flange 120*a* of an outer shell panel 120 is bent at around 90 degrees. FIG. 6 also illustrates the state of wrinkles that have formed in the upper corner bend portion 120*b*. As illustrated in FIG. 6, in a case where the flange 120*a* is formed in a sheet metal component, and the sheet metal component is bent at the corner portion together with the flange 120*a*, wrinkles normally form in the corner bend portion (the upper corner bend portion 120*b*) of the flange 120*a* owing to the characteristics of the sheet metal component.

It is apparent from FIG. 6 that the outwardly projecting portion of the wrinkles that have formed in the upper corner bend portion 120*b* lies outside the ideal bending line 120*c*. Consequently, the distance between the outer surface of the wrinkles that have formed in the upper corner bend portion 120*b* and the inner surface of the corner portion of the top panel becomes short. Therefore, when mounting the top panel to the upper side of the outer shell panel 120, the top panel does not fit the upper side of the outer shell panel 120 with accuracy, resulting in deterioration of workability.

At this time, forcefully pushing the top panel to the upper side of the outer shell panel 120 for fitting causes rubbing or the like to occur between the wrinkles that have formed in the upper corner bend portion 120*b* and the inner surface of the corner portion of the top panel. This causes the coating in this contact portion to come off, which increases the possibility of rust forming in that portion. However, in a case where the flange 120*a* of the sheet metal component is bent at the corner portion as in the case of the outer shell panel 120, it is considered difficult to control, for example, the size or position of the wrinkles.

Accordingly, in the outer shell panel 12, as illustrated in FIG. 4, an inclined portion 12*d* is created from the beginning in the flange 12*a* that is to be bent at around 90 degrees and becomes the upper corner bend portion 12*b*. The inclined portion 12*d* is formed between a linear portion 12*g*, which is the linear portion of the flange 12*a* of the outer shell panel 12, and the upper corner bend portion 12*b*. As a result, in a state in which the outer shell panel 12 is completed, the upper corner bend portion 12*b* is connected to the linear portion 12*g* via the inclined portion 12*d* that is located inside an ideal bending line 12*c* of the upper corner bend portion 12*b*.

At the time of creating the outer shell panel 12, the inclined portion 12*d* may be created as follows. That is, at least the bend beginning portion of the flange 12*a* of a portion of the sheet metal component constituting the outer shell panel 12 to which bending is applied is inclined in the bending direction (inwards) at a predetermined angle, with respect to at least the linear portion of the flange 12*a* of the sheet metal component constituting the outer shell panel 12. When bending is then applied to the sheet metal component constituting the outer shell panel 12, the upper corner bend portion 12*b* is located inside the ideal bending line 12*c* of the upper corner bend portion 12*b*, with the inclined portion 12*d* therebetween. It is to be noted that two inclined portions 12*d* are formed per one upper corner bend portion 12*b*.

FIG. 4 illustrates the ideal bending line 12*c* of the upper corner bend portion 12*b* in the case where the flange 12*a* of the outer shell panel 12 is bent at around 90 degrees. FIG. 4 also illustrates an ideal bending line 12*e* of the upper corner bend portion 12*b* when the flange 12*a* of the outer shell panel 12 is bent at around 90 degrees after the inclined portion 12*d* is formed. Further, FIG. 4 also illustrates the state of wrinkles that have formed in the upper corner bend portion 12*b* that is formed after the inclined portion 12*d* is formed.

As for the inclination angle and length of the inclined portion 12*d*, the inclined portion 12*d* is formed with such an inclination angle and a length that when the upper corner bend portion 12*b* is formed, the outwardly projecting portion of the wrinkles that form in the upper corner bend portion 12*b* (a wrinkled portion 12*f* illustrated in FIG. 4) can be located inside the ideal bending line 12*c*. However, the inclination angle and length of the inclined portion 12*d* cannot be predefined unconditionally since their optimum numerical values vary depending on the kind of the sheet metal constituting the outer shell panel 12 and the size of the outdoor unit 60. Further, the inclination angles and lengths of two inclined portions 12*d* that are formed per one upper corner bend portion 12*b* may be the same or different.

As illustrated in FIGS. 4 and 5, forming the inclined portion 12*d* has the following effect. That is, when the upper corner bend portion 12*b* is formed, the outwardly projecting portion of the wrinkled portion 12*f* is located inside the ideal bending line 12*c*, although the outwardly projecting portion lies outside the ideal bending line 12*e*. FIG. 5 is a conceptual illustration of an ideal state after bending of the upper corner bend portion 12*b* that is provided with the inclined portion 12*d*. Further, the upper corner bend portion 12*b* can be made to have the same height as the linear portion 12*g* of the flange 12*a*.

Consequently, even if the outwardly projecting portion of the wrinkled portion 12*f* lies outside the ideal bending line 12*c*, this portion does not lie outside the ideal bending line 12*e*, and does not come into contact with an inner surface 14*a* of the corner portion of the top panel 14. Therefore, no rubbing or the like occurs between the wrinkled portion 12*f* and the inner surface 14*a* of the corner portion of the top panel 14, with the result that the coating in that portion does not come off. Therefore, formation of rust in that portion can be significantly reduced.

Further, the provision of the inclined portion 12*d* makes it unnecessary to make a cut in the upper corner bend portion 12*b* to suppress wrinkles or reduce the height of the upper corner bend portion 12*b*, thereby eliminating the risk of rusting caused by penetration of moisture such as rain from the outside. Making a cut in the upper corner bend portion to suppress wrinkles has the following problem. That is, because no coating is applied to the end face of the cut portion, moisture that penetrates from the outside tends to adhere to the end face, which aggravates formation of rust. Further, reducing the height of the upper corner bend portion to suppress wrinkles has the following problem. That is, moisture that penetrates from the outside tends to adhere to the end face of the reduced-height portion of the upper corner bend portion, which also aggravates formation of rust.

While the upper corner bend portion 12*b* at the upper right front portion of the outer shell panel 12 has been described in Embodiment, the same configuration can be applied to the upper corner bend portion at the upper left front portion of the outer shell panel 12 and the upper corner bend portion of the side panel 13. Further, creating the inclined portion 12*d* results in the upper corner bend portion 12*b* projecting inwardly more than a case where the inclined portion 12*d* is not provided. However, this presents no particular problem since no component that may come into contact with the upper corner bend portion 12*b* exists at positions corresponding to the upper corner bend portion 12*b* in either of the machine room 9 and the air-sending-device room 5.

Although the same effect as mentioned above can be obtained by forming the corner portion of the top panel 14 to have an outwardly bulged shape without creating the inclined portion 12*d* in the upper corner bend portion 12*b* of the outer shell panel 12, such outward bulging of the top panel 14 impairs the appearance aesthetically.

As described above, in the outdoor unit 60, the upper corner bend portion 12*b* is formed by bending the flange 12*a* in a state in which the inclined portion 12*d* is created. As a result, the wrinkled portion 12*f* does not come into contact with the inner surface 14*a* of the corner portion of the top panel 14. Therefore, according to the outdoor unit 60, the workability at the time of fitting the top panel 14 does not deteriorate, rubbing or the like does not occur between the wrinkled portion 12*f* and the inner surface 14*a* of the corner portion of the top panel 14, and the coating in that portion does not come off, with the result that formation of rust in that portion can be significantly reduced. Further, because the air-conditioning apparatus A includes the outdoor unit 60, degradation of quality can be significantly reduced.

[Reference Signs List]

1 L-bend heat exchanger, 2 propeller fan, 3 motor, 4 motor support, 5 air-sending-device room, 6 compressor, 7 refrigerant pipe, 8 electrical parts box, 9 machine room, 10 separator, 11 bottom plate, 12 outer shell panel, 12A corner bend portion, 12*a* flange, 12*b* upper corner bend portion, 12*c* bending line, 12*d* inclined portion, 12*e* bending line, 12*f* wrinkled portion, 12*g* linear portion, 13 side panel, 13A corner bend portion, 13*a* flange, 14 top panel, 14A side surface, 14*a* inner surface, 50 indoor unit, 51 installation plate, 57 air inlet, 58 air outlet, 59 screw, 60 outdoor unit, 61 support base, 120 outer shell panel, 120*a* flange, 120*b* upper corner bend portion, 120*c* bending one, A air-conditioning apparatus

The invention claimed is:

1. An outdoor unit comprising:

a first panel that has a primary corner bend portion, the primary corner bend portion having been subjected to bending together with a flange formed in an upper portion of the first panel to form a flange corner bend portion between a first flange linear portion and a second flange linear portion; and a second panel that has a side surface, the second panel being attached to an upper portion of the first panel in such a way that an outer surface of the flange of the first panel comes into contact with an inner surface of the side surface, wherein the flange corner bend portion is connected to the first flange linear portion via a first inclined portion, the first inclined portion being a portion of the flange that is inclined from the first flange linear portion at a predetermined angle in a flange bending direction of the flange corner bend portion, a primary bending direction of the primary corner bend portion is the same as the flange bending direction, and the flange corner bend portion includes a wrinkled portion, and an outwardly projecting portion of the wrinkled portion is located inside an ideal bending line of the upper corner bend portion when the flange is bent around 90 degrees after the first inclined portion is formed.

2. The outdoor unit of claim 1, wherein the inclined portion is created by inclining at least a bend beginning portion of the flange of a portion, subject to bending, of a sheet metal component constituting the first panel at the predetermined angle in the bending direction of the flange corner bend portion with respect to at least the first linear portion of the flange of the sheet metal component constituting the first panel.

3. The outdoor unit of claim 1, wherein the flange corner bend portion has a height that is same as a height of the linear portion of the flange.

4. The outdoor unit of claim 1, wherein:

the first panel includes an outer shell panel including a front panel and a first side surface part that are integrated together, and a side panel including a second side surface part and a back panel that are integrated together; and the inclined portion is formed in at least one of the flange corner bend portion of the outer shell panel and the side panel.

5. The outdoor unit of claim 1, wherein:

the flange corner bend portion is connected to the second flange linear portion via a second inclined portion, the second inclined portion being a portion of the flange that is inclined from the second flange linear portion at a predetermined angle in the flange bending direction of the flange corner bend portion.

6. An air-conditioning unit comprising an outdoor unit and an indoor unit, the outdoor unit including a first panel that has a primary corner bend portion, the primary corner bend portion having been subjected to bending together with a flange formed in an upper portion of the first panel to form a flange corner bend portion between a first flange linear portion and a second flange linear portion, and a second panel that has a side surface, the second panel being attached to an upper portion of the first panel in such a way that an outer surface of the flange of the first panel comes into contact with an inner surface of the side surface, and the indoor unit being connected to the outdoor unit, wherein the flange corner bend portion is connected to the first flange linear portion via a first inclined portion, the first inclined portion being a portion of the flange that is inclined from the first flange linear portion at a predetermined angle in a flange bending direction of the flange corner bend portion, and a primary bending direction of the primary corner bend portion is the same as the flange bending direction, and the flange corner bend portion includes a wrinkled portion, and an outwardly projecting portion of the wrinkled portion is located inside an ideal bending line of the upper corner bend portion when the flange is bent around 90 degrees after the first inclined portion is formed.

7. The air-conditioning unit of claim 6, wherein:

the flange corner bend portion is connected to the second flange linear portion via a second inclined position, the second inclined portion being a portion of the flange that is inclined from the second flange linear portion at a predetermined angle in the flange bending direction of the flange corner bend portion.

* * * * *